United States Patent [19]

Fule

[11] 4,286,503

[45] Sep. 1, 1981

[54] MACHINE OF THE AXIAL PISTON PUMP TYPE WHICH CAN BE USED AS A PUMP OR AS A MOTOR

[76] Inventor: Stefan Fule, Schwalheimer Strasse 23, D-6350 Bad Nauheim, Fed. Rep. of Germany

[21] Appl. No.: 889,363

[22] Filed: Mar. 23, 1978

[30] Foreign Application Priority Data

Mar. 24, 1977 [DE] Fed. Rep. of Germany ..... 2713009

[51] Int. Cl.[3] ..... F01B 13/04

[52] U.S. Cl. ..... 91/507

[58] Field of Search ..... 91/485–487, 91/499–507

[56] References Cited

U.S. PATENT DOCUMENTS

| | | | |
|---|---|---|---|
| 1,087,160 | 2/1914 | Eizerman | 91/507 |
| 1,183,470 | 5/1916 | Lee | 91/507 |
| 1,211,879 | 1/1917 | Robertson | 91/507 |
| 1,912,284 | 5/1933 | La Brie | 91/507 |
| 2,679,139 | 5/1954 | Dosson | 91/507 |
| 3,096,723 | 7/1963 | Puryear | 91/485 |
| 3,175,510 | 3/1965 | D'Amato | 91/505 |
| 3,527,145 | 9/1970 | Ritter | 91/505 |
| 3,808,950 | 5/1974 | Davies | 91/487 |
| 3,857,326 | 12/1974 | Blandford | 91/497 |
| 4,086,895 | 5/1978 | Taragi | 91/483 |
| 4,138,203 | 2/1979 | Slack | 417/269 |

FOREIGN PATENT DOCUMENTS

| | | | |
|---|---|---|---|
| 36906 | 12/1908 | Austria | 91/502 |
| 2018804 | 11/1971 | Fed. Rep. of Germany | 91/487 |
| 1022113 | 2/1953 | France | 91/507 |

*Primary Examiner*—William L. Freeh

[57] ABSTRACT

A machine of the axial piston pump type used as a pump or motor including a cylinder drum mounted rotatably in a casing. Working pistons are included in the drum in working cylinders and driven as the drum rotates. The casing terminates in a tubular duct coaxial therewith that defines one of the suction and pressure openings of the machine. The tubular duct is of a diameter generally the same as that of the drum to provide for the direct flow of fluid medium to the working cylinders without undergoing a change in the direction of flow. The tubular duct terminates in a first connecting flange, and a second duct defines the other of the suction and pressure openings and terminates in a second connecting flange that extends to the side of the tubular duct.

17 Claims, 6 Drawing Figures

MACHINE OF THE AXIAL PISTON PUMP TYPE WHICH CAN BE USED AS A PUMP OR AS A MOTOR

BACKGROUND AND BRIEF DESCRIPTION OF THE INVENTION

The invention relates to a machine of the axial piston pump type which can selectively be used as a pump or as a motor.

A known piston pump is described in German Patent Specification No. 658,937. In this previously known piston pump the suction duct and delivery duct extend laterally outwards through bores in the wall of the pump casing. Because the pistons deliver in the axial direction and the outlet is situated in the radial direction, these ducts have a number of sharp bends. This results in not only dead space but also an additional throttling action, so that the efficiency of this previously known piston pump cannot be satisfactory. In addition, because of these relatively narrow ducts in which there are a number of sharp bends, it is impossible to pump thick matter with this pump. Furthermore, suction speed is reduced. It can be regarded as an additional disadvantage that in this pump the piston rods of the working cylinders are guided by two control cams extending parallel to one another, namely a delivery cam and a suction cam. For the purpose of guidance on the suction cam the piston rods have lateral slide blocks, while the piston rods run with their hemispherically rounded free ends on the suction cam. It is not only expensive to form these two control cams on the piston pump and to adjust them to one another, but in addition it is a disadvantage that considerable abrasion occurs during operation between the abovementioned components of the piston rod and the two control cams, so that this previously known piston pump must have only a short life, together with the additional disadvantage of inaccurate dispensing. Moreover, during the operation of this known piston pump vibration and noise occur which are disturbing and further shorten its life.

In connection with the prior art reference is also made to German Patent Specification No. 707,462 and U.S. Pat. No. 2,780,170, which describe piston pumps having the same disadvantages. Furthermore, with these pumps it is impossible to achieve high rotational speeds, because the piston rods are guided only in one axial direction. If a relatively low limit speed is exceeded, the piston rods lift off their guide, so that once again inaccurate delivery, irregular running, wear, and the like occur.

The invention avoids these disadvantages. It seeks to provide a machine of the axial piston pump type which is distinguished by delivery behaviour independent of viscosity, long life, and inexpensive manufacture. In addition, the machine should be capable of selective use as a pump or motor without further constructional modifications.

Starting with a machine of the kind first mentioned above, this is achieved according to the invention through the fact that the cylinder drum rotates with its free end directly in the medium being pumped.

The suction ducts, delivery ducts, and valves otherwise provided are thus dispensed with. Induction (when operating as a pump) or exhaust (when operating as a motor) is on the contrary effected without throttling. The delivery behaviour of the novel machine is independent of the viscosity of the medium to be pumped in each particular case. Thick matter, mortar, concrete, dressed mining products (ores), and the like can for example be delivered and metered. A high suction speed is achieved, together with optimum volumetric efficiency, particularly because there is no dead space. The novel machine is particularly suitable for a short-stroke construction. This compact construction leads to a high power-to-weight ratio. The high accuracy of delivery that can be achieved makes the new machine particularly suitable for metering (operating as a pump) and operational use in the medium to very high pressure range.

The machine described can be used as a pump or as a motor without constructional modifications. Depending on the purpose for which it is to be used, one or more delivery ducts may also be provided on the same machine without additional constructional modifications.

Because the same machine can be used without constructional modifications either as a pump or as a motor, the advantage of rational manufacture in large numbers is achieved, together with the lowest possible expense for keeping stocks and for the building of these machines, this being likewise applicable to spare parts.

With an increasing number of delivery ducts the working stroke performed per revolution of the cylinder drum is increased in proportion. This leads to high power density with low requirements of material. With an increasing number of connection flanges the possibility of direct connection of consumers without an additional distribution station is increased.

It is preferred for each working cylinder to have its end face inserted in a recess in the cylinder drum in such a manner as to be axially movable. The working cylinder thus acts at the same time as a seal between the delivery and suction chambers during the delivery operation. The cylinder bush is frictionally connected to the oscillating piston seal. The advancing piston presses the cylinder bush at the end face against a closure plate, so that sealing is ensured even when sliding surfaces have worn.

In an important further development of the object of the invention the control cam is in the form of a guide path which is partly closed in the direction of the piston. As a consequence the piston rods cannot lift off the guide path even at high rotational speeds. It is also unnecessary to provide a second, parallel guide path.

In this connection it is likewise preferred that the end of the piston rod which is guided by the control cam should be in the form of a ball mounted for universal rotation. Together with an oil film, this ensures that during operation the ball will float on the film of oil, so that the ball simply rolls, without sliding, on the track and on its support. In the prior art, on the other hand, mixed movements (rolling and sliding) are made, which even if a lubricant is used leads to increased wear. With the object of the application a long life is thus achieved, together with great operational reliability and precise stroke guidance with operating behaviour free from vibration and independent of rotational speed.

A further contribution is made towards a long life together with small dead spaces if the cylinder drum is closed at its free end by a closure disc against which a closure plate fastened to the casing is elastically pressed. Between the working volume of the working cylinders and the free outer space of the machine there is thus situated only the very small volume in the bores, which are in line with one another, in the closure disc and closure plate. These two components are pressed elastically against one another by a sealing ring, so that the seal is automatically adjusted even after abrasion has occurred.

When the machine is used as a pump for liquid substances it may be advantageous for a leakage current valve to be inserted into the free end of the cylinder drum. This leakage current valve conducts in a closed circuit to the suction side of the machine any medium which leaks through there.

It is in addition preferable for the ball to be mounted, with clearance, in a rider for universal rotation. This can be achieved inexpensively by modern methods of manufacture. Thus there is also no wear at the mounting of the ball on the piston rod side, because the ball is also guided in the rider, unhindered and without sliding, on the oil film.

Pumping power is increased if an impeller which rotates in the medium being pumped is rotationally fastened to the cylinder drum. This impeller thus serves as a preceding loading device.

In some applications it may be advantageous for the cylinder drums of two machines of the kind described to be coupled together. One of these machines thus works as a motor and the other machine, coupled to it, as a pump.

The invention involves a machine of the axial piston pump type which can be selectively used as a pump or as a motor for a fluid medium. A cylinder drum is mounted rotatably in a casing, and working pistons are axially displaceable in working cylinders in axial bores distributed over the periphery of the cylinder drum. Piston rods are connected to the working pistons and have ends that run on a control cam which is fastened to the casing. The cam is concentric to a central shaft and extends undulatingly in the axial direction so that a rotary movement of the cylinder drum is converted into a reciprocating movement of the working pistons, or vice versa. At least one suction opening and one pressure opening are provided fixed to the casing and communicating with the working cylinders. In this general environment, the invention involves terminating the casing in a tubular duct that is coaxial with the casing and which defines one of the openings. This tubular duct is of a diameter generally about the same as that of the drum to provide for the direct flow of fluid medium to the working cylinders without undergoing a change in the direction of flow. The tubular duct terminates in a first connecting flange, and a second duct defines the other of the openings and terminates in a second connecting flange that extends to the side of the tubular duct.

The invention is explained more fully below with the aid of examples of embodiment, from which further important features can be seen.

DETAILED DESCRIPTION

Figures 1, 3:
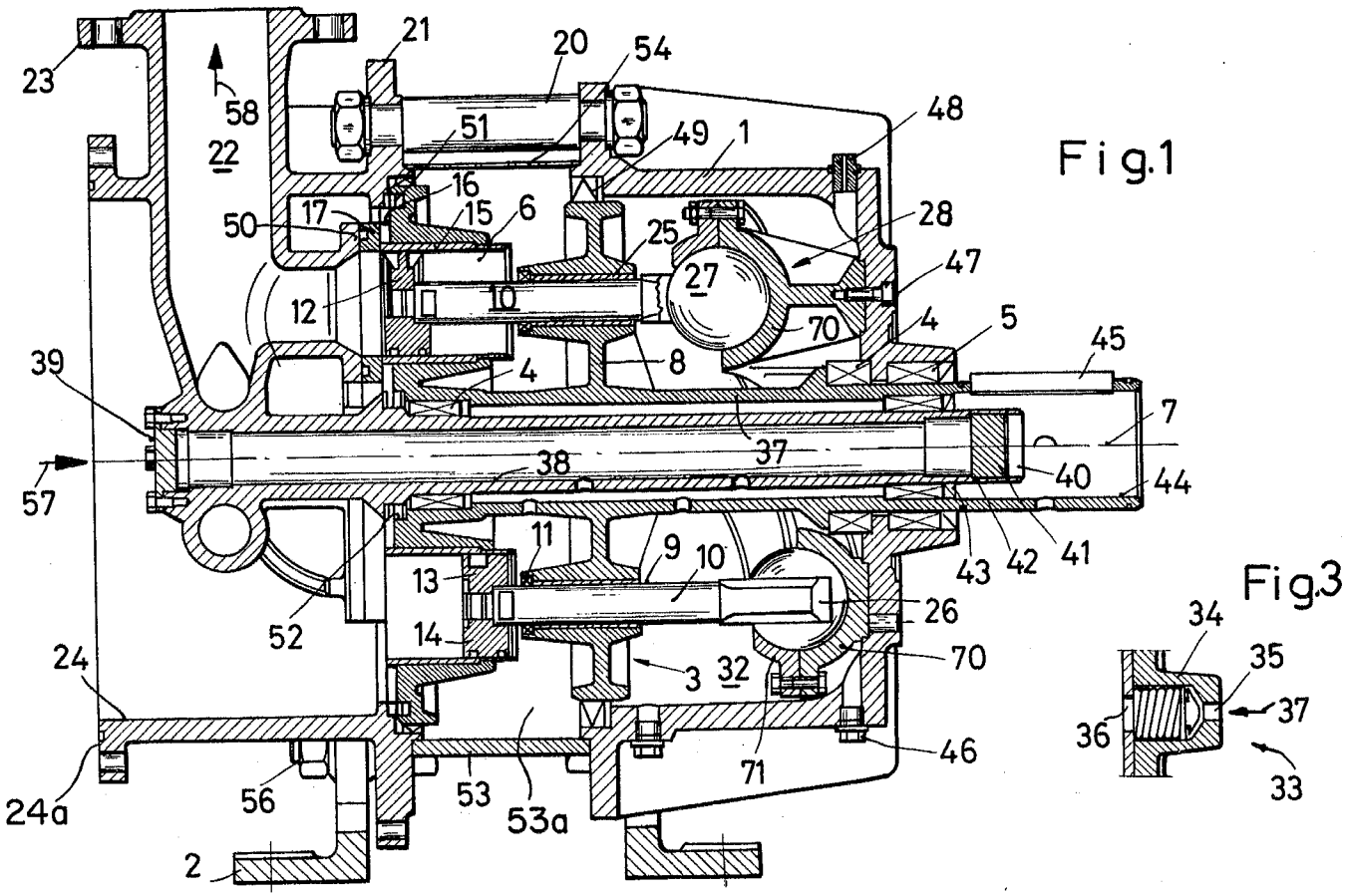
FIG. 1 is a longitudinal section through a basic construction of a machine according to the invention.
FIG. 3 shows on a larger scale a detail of FIG. 1, illustrating a leakage current valve inserted in the cylinder drum.

The basic construction of the novel machine will first be explained with reference to FIGS. 1 and 2.

A cylinder drum 3 is mounted for rotation by means of radial bearings 4, 5 in a casing 1 having a foot 2. A number of working cylinders 6 are distributed over the periphery of the cylinder drum. In the example of embodiment illustrated there are four such working cylinders. However, the number of working cylinders may be larger or smaller. At this point it may be observed that in FIG. 1 the portion below the axis of rotation 7 is shown at an angle of 90° to the portion lying above this axis of rotation.

The cylinder drum 3 has a radial flange 8 which has distributed over its periphery a plurality of bores 9 the number of which corresponds to the number of working cylinders. In these bores are guided piston rods 10 which are adapted to move to-and-fro in the axial direction. For this purpose radial seals 11 are provided.

Pistons 12, 13, or 14, the construction of which depends on the medium used, are connected to those ends of the piston rods 10 which lie on the left in FIG. 1. For example, pistons 12 are used for abrasive media, pistons 13 for media having a good lubricating action, and pistons 14 for poorly lubricating and corrosive media.

The working cylinders 6 have cylinder bushes 15 which are inserted from the end face into corresponding recesses in the cylinder drum 3. Because of the previously mentioned frictional connection between the piston and its bush, the bush is sealingly pressed against a closure plate 17 during the stroke movement of the piston.

A closure disc 16 lies opposite this closure plate. The closure disc and the closure plate have bores 18 which are in line with one another (see also FIG. 2). The closure disc 16 is fixed to the rotatable drum 3, and thus rotates with that drum. The closure plate 17 is fixed to the housing or casing 1, and hence is held stationary. There is accordingly a relative rotating movement between the closure disc 16 and the closure plate 17. The openings or bores 18 in the closure disc 16 and closure plate 17 are identical in number and shape. In FIG. 2, two of such openings 18 are shown. When the openings 18 in the closure disc 16 are coincident with the openings 18 in the closure plate 17, there is a full passage for fluid flow provided. In this position, the piston 13, 14 at the lower side of FIG. 1 is in its lowermost position, and the opposite piston 12 at the upper side of FIG. 1 is in its uppermost position. In FIG. 1 the showing is such that the uppermost piston 12 is expelling the medium out of the duct 22, while the lowermost piston 13, 14 is sucking the fluid medium into its cylinder 6 in the direction of arrow 57. In addition, FIG. 2 shows a pipe wall 19 provided with sealing rings. Fastening bolts 20 connect together the components of the casing 1. The ends of the fastening bolts 20 which lie on the left in FIG. 1 are inserted into an annular flange 21 which is provided on the casing and to which a duct 22 having a connecting flange 23 is fastened. It will be noted that the duct 24 is tubular and terminates the casing and defines one of the openings to the pump/motor assembly. The diameter of the duct 24 is generally about the same as that of the drum 3 to provide for the direct flow of the fluid medium to the working cylinders 6 without undergoing a change in the direction of flow. The duct 24 terminates in a connecting flange 24*a*. The duct 22 defines the other of the openings to the pump/motor assembly and extends to the side of the duct 24. This flange 21 also forms an axial duct 24.

The piston rods 10 slide in slide bushes 25. At their right-hand ends (in FIG. 1) they are constructed as riders, which can be seen more clearly in FIGS. 5 and 6. Each of these riders 26 carries a captive ball 27. All the balls run on an undulating guide 28 which, viewed in the axial direction, forms a circle 29 (see FIG. 2).

Figure 5:
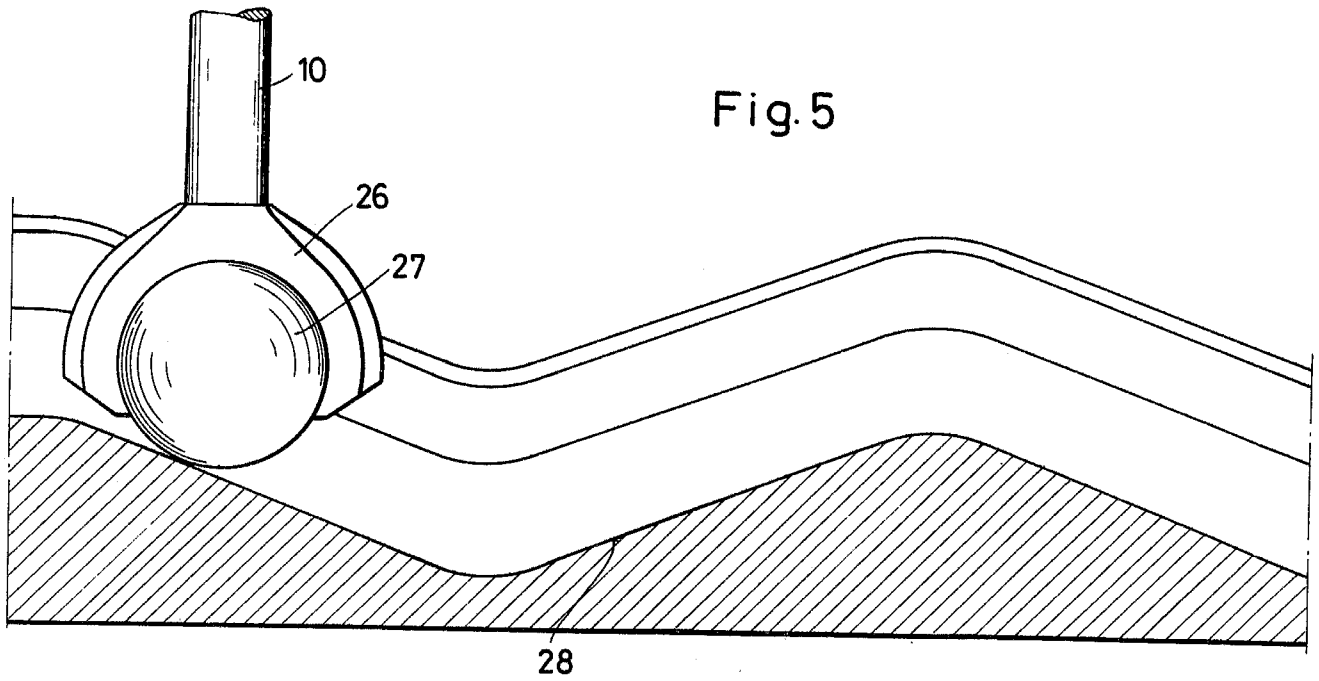
FIG. 5 shows a development of part of the control cam in a machine of this kind, together with the bottom end of a piston rod, a rider, and a ball inserted in the rider.
Figure 6:
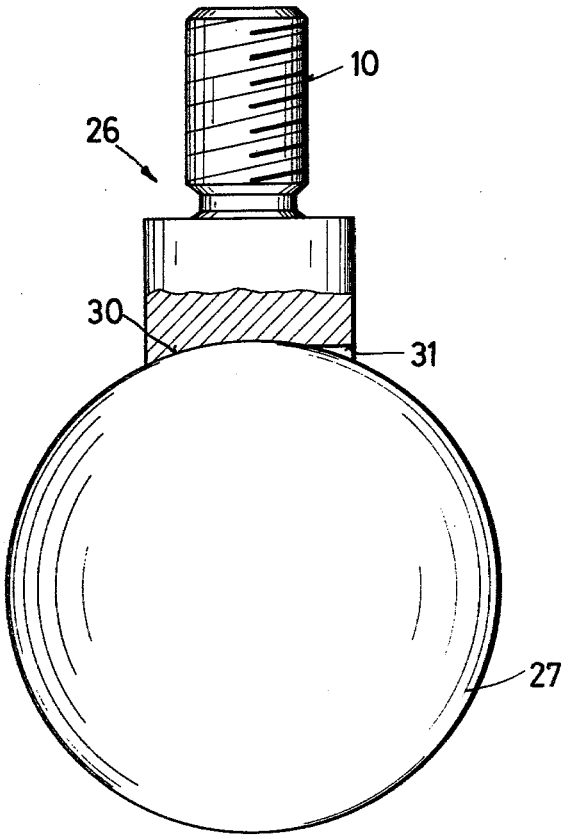
FIG. 6 is an elevation, partly in section, of the rider and ball at right angles to FIG. 5.

FIGS. 5 and 6 show that the balls run in spherical cups 30 which are provided in the riders 26 and have straight cylindrical cutouts on one side. The diameter of the balls 27 is smaller than the diameter of these cups 30 and also smaller than the diameter of the straight cylindrical cutout 31. For assembly purposes the riders are heated so that they expand. The cold ball is inserted in this heated rider. When the rider cools the spherical cup bore contracts and the ball is thus captive, with clearance, in it. The space 32 (see FIG. 1) in which the balls run on the guides is filled with oil.

Figure 2:
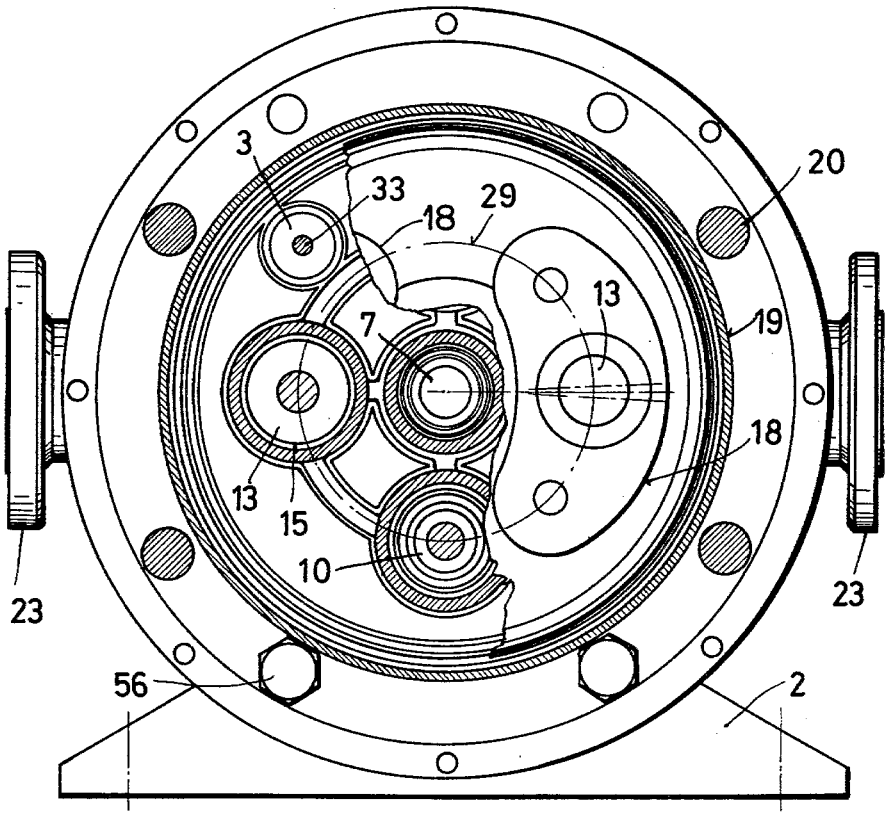
FIG. 2 is an end view of the machine of FIG. 1, looking in the direction of the arrow 57 in FIG. 1.

A number of leakage current valve 33 can be disposed on the end face of the cylinder drum 3, distributed over the periphery (see FIGS. 1 and 2). These valves consist of a spring-loaded cap 34 which resiliently closes a bore 35 in the cylinder drum 3. Facing the bore 35, a bore 36 is provided in the closure disc 16. When leaks occur, collecting in the chamber 53*a*, they flow in the direction of the arrow 37 back into the axial duct 24, from which they are included in the pumping circuit.

In the embodiment shown in FIG. 1 a shaft 38 which is a part of the casing 1 extends in the inner wall 37. The end face of this hollow shaft is closed by a detachable cover 39. On the rear end of the shaft 38 is disposed a securing ring 40 behind which a closure disc 41 is provided. Behind the latter a sealing ring 42 is in turn disposed. A radial sealing ring 43 extends between the hub of the pressure duct 38 and an annular cylndrical extension 44 of the cylinder drum 3. A key 45 is inserted in this extension.

In the wall of the casing 1 closure screws 46 are also provided, as well as screws 47 for fastening the guide 28, and vent screws 48. A radial sealing ring 49 seals the rotating flange 8 against the casing 1. A set of seals 50 presses the closure plate 17 elastically against the closure disc 16. In addition, a radial sealing ring 51 is provided for sealing the cylinder drum against the flange 21. The cylinder drum is sealed against the shaft 38 by a set of seals 52.

On the wall of the casing is disposed either a tubular jacket 53 with sealing rings or a jacket grid 54, depending on the medium to be pumped. The jacket grid 54 with its holes normally is used when an abrasive medium is being pumped, eliminating use of valves 33.

The foot 2 is fastened by bolts 56 to the casing.

When the machine is operated as a pump, the medium to be pumped is drawn into the duct 24 in the direction of the arrow 57 and passes out of the machine through the duct 22 in the direction of the arrow 58. For this purpose the cylinder drum is driven by means of the extension 44.

When the machine is used as a motor, conditions are reversed.

Figure 4:
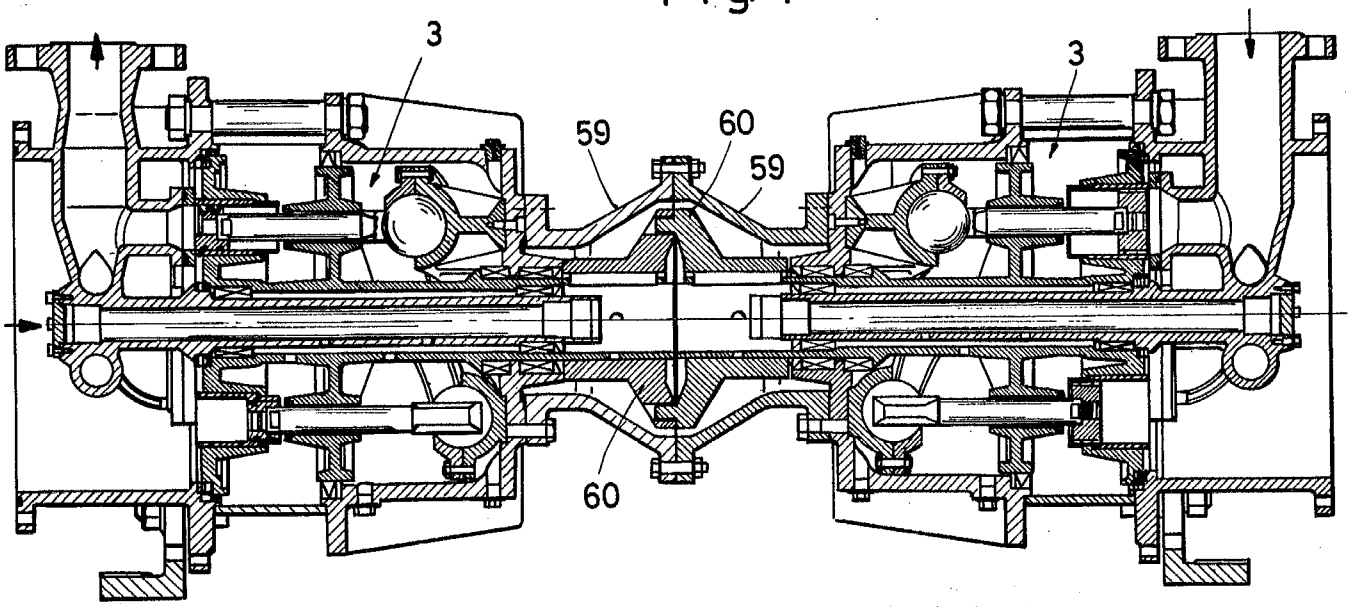
FIG. 4 shows two machines according to FIG. 1, which are mechanically coupled together and of which one is used as a motor and the other as a pump.

FIG. 4 shows an embodiment in which two of the machines according to FIG. 1 are coupled together. This is done with the aid of flange casings 59 and claw couplings 60 on both machines. The machine on the right in FIG. 4 is for example operated as a motor and the machine on the left in FIG. 4 as a pump.

Figure 7:
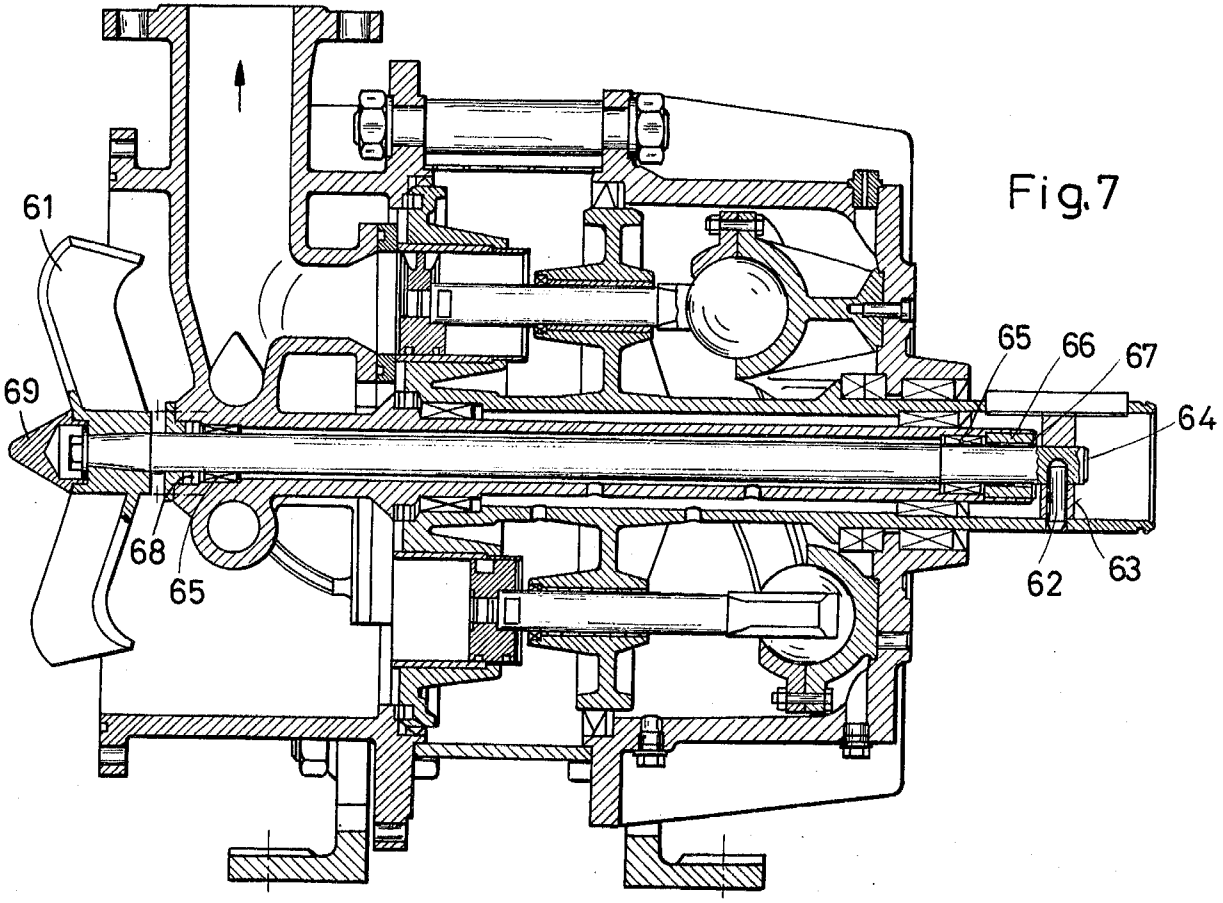
FIG. 7 is a sectional view corresponding to FIG. 1 with an additionally fitted impeller as loading device.

FIG. 7 shows basically the same machine as in FIG. 1. In addition, however, an impeller 61 is coupled mechanically to the cylinder drum 3. This is achieved with the aid of a coupling pin 62 with a disc 63 and with the aid of a shaft 64 inserted into the shaft 38. The shaft 64 is mounted by radial bearings 65 in the hub bore of the delivery duct. A supporting plate 66 supports the bearing 65. Item 67 is a radial shaft seal, item 68 a set of radial seals, and item 69 a protective cap for the hub.

As can be seen in FIG. 1, the guide 28 consists of a bottom guide path 70 which has a semicircular profile. To this guide path 70 is bolted an upper partial path 71 which extends over an angle of about 45°. It is thereby ensured that the guide path 28 will be partly closed in the direction of the piston rod 10, so that the balls 27 cannot come out of the guide path.

Because of the undulating shape of the guide path, during operation each working pistion of the total of four cylinders in the example of embodiment illustrated performs in each case a downward stroke (suction stroke) which is followed by an upward stroke (delivery stroke), followed again by a suction stroke and a further delivery stroke. The cycle then starts again.

I claim:

1. In a machine of the axial piston pump type which can be selectively used as a pump or as motor for a fluid medium, which comprises a cylinder drum which is mounted rotatably in a casing and in which working pistons are axially displaceable in working cylinders in axial bores distributed over the periphery of the cylinder drum, wherein piston rods are connected to the working pistons and have ends that run on a control cam which is fastened to the casing, said cam is concentric to a central shaft and extends undulatingly in the axial direction so that a rotary movement in the cylinder drum is converted into a reciprocating movement of the working pistons, or vice versa, and wherein at least one suction opening and one pressure opening are provided which are fixed to the casing and which communicate with said working cylinders, the improvement wherein said casing terminates in a tubular duct coaxial therewith that defines one of said openings and is of a diameter generally about the same as that of said drum to provide for the direct flow of said fluid medium to said working cylinders without undergoing a change in the direction of flow, said tubular duct terminating in a first connecting flange of a diameter generally about the same as that of said drum, and a second duct defines the other of said openings and terminates in a second connecting flange and extends to the side of said tubular duct, said first and second ducts are formed by a common fixed means which forms the inlet and outlet for a rotary barrel pump or motor, and said second duct is located in a radial side of said tubular duct.

2. A machine according to claim 1, in which each working cylinder has a bushing inserted therein and held there by a plate having one or more openings for the fluid medium.

3. A machine according to claim 1, in which said control cam is in the form of a guide path which is partly closed toward said pistons.

4. A machine according to claim 1, in which an impeller rotates in said fluid medium and is rotationally fixed to said cylinder drum.

5. Two machines each according to claim 1 in which the cylinder drums of both are coupled together.

6. A machine according to claim 1, in which said second duct is led from one of said axial bores directly to said side of said tubular duct.

7. A machine according to claim 1, in which that end of each piston rod which is guided by the control cam is in the form of a ball mounted for universal rotation.

8. A machine according to claim 7, in which said ball is mounted for universal rotation, with play, in a rider.

9. A machine according to claim 8, in which said ball runs on a film of a lubricant.

10. A machine according to claim 1, in which said cylinder drum is closed by a closure disc at a free end thereof against which a closure plate fastened to said casing is elastically pressed.

11. A machine according to claim 10, in which a leakage current valve is inserted into said free end of said cylinder drum.

12. In a machine of the axial piston pump type which can be selectively used as a pump or as motor for a fluid medium, which comprises a cylinder drum which is mounted rotatably in a casing and in which working pistons are axially displaceable in working cylinders in axial bores distributed over the periphery of the cylinder drum, wherein piston rods are connected to the working pistons and have ends that run on a control cam which is fastened to the casing, said cam is concentric to a central shaft and extends undulatingly in the axial direction so that a rotary movement in the cylinder drum is converted into a reciprocating movement of the working pistons, or vice versa, and wherein at least one suction opening and one pressure opening are provided which are fixed to the casing and which communicate with said working cylinders, the improvement wherein said casing terminates in a tubular duct coaxial therewith that defines one of said openings and is of a diameter generally about the same as that of said drum to provide for the direct flow of said fluid medium to said working cylinders without undergoing a change in the direction of flow, said tubular duct terminating in a first connecting flange, and a second duct defines the other of said openings and terminates in a second connecting flange and extends to the side of said tubular duct, said cylinder drum is closed by a closure disc at a free end thereof against which a closure plate fastened to said casing is elastically pressed, and a leakage current valve is inserted into said free end of said cylinder drum.

13. In a machine of the axial piston pump type which can be selectively used as a pump or as motor for a fluid medium, which comprises a cylinder drum which is mounted rotatably in a casing and in which working pistons are axially displaceable in working cylinders in axial bores distributed over the periphery of the cylinder drum, wherein piston rods are connected to the working pistons and have ends that run on a control cam which is fastened to the casing, said cam is concentric to a central shaft and extends undulatingly in the axial direction so that a rotary movement in the cylinder drum is converted into a reciprocating movement of the working pistons, or vice versa, and wherein at least one suction opening and one pressure opening are provided which are fixed to the casing and which communicate with said working cylinders, the improvement wherein said casing terminates in a tubular duct coaxial therewith that defines one of said openings and is of a diameter generally about the same as that of said drum to provide for the direct flow of said fluid medium to said working cylinders without undergoing a change in the direction of flow, said tubular duct terminating in a first connecting flange, and a second duct defines the other of said openings and terminates in a second connecting flange and extends to the side of said tubular duct, and characterized by two machines each as defined above, in which the cylinder drums of both machines are coupled together.

14. In a machine of the axial piston pump type which can be selectively used as a pump or as motor for a fluid medium, which comprises a cylinder drum which is mounted rotatably in a casing and in which working pistons are axially displaceable in working cylinders in axial bores distributed over the periphery of the cylinder drum, wherein piston rods are connected to the working pistons and have ends that run on a control cam which is fastened to the casing, said cam is concentric to a central shaft and extends undulatingly in the axial direction so that a rotary movement in the cylinder drum is converted into a reciprocating movement of the working pistons, or vice versa, and wherein at least one suction opening and one pressure opening are provided which are fixed to the casing and which communicate with said working cylinders, the improvement wherein said casing terminates in a tubular duct coaxial therewith that defines one of said openings and is of a diameter generally about the same as that of said drum to provide for the direct flow of said fluid medium to said working cylinders without undergoing a change in the direction of flow, said tubular duct terminating in a first connecting flange of a diameter generally about the same as that of said drum, and a second duct defines the other of said openings and terminates in a second connecting flange and extends to the side of said tubular duct, that end of each piston rod which is guided by the control cam is in the form of a ball mounted for universal rotation, and said ball is mounted for universal rotation, with play, in a rider.

15. A machine according to claim 14, in which said ball runs on a film of a lubricant.

16. In a machine of the axial piston pump type which can be selectively used as a pump or as motor for a fluid medium, which comprises a cylinder drum which is mounted rotatably in a casing and in which working pistons are axially displaceable in working cylinders in axial bores distributed over the periphery of the cylinder drum, wherein piston rods are connected to the working pistons and have ends that run on a control cam which is fastened to the casing, said cam is concentric to a central shaft and extends undulatingly in the axial direction so that a rotary movement in the cylinder drum is converted into a reciprocating movement of the working pistons, or vice versa, and wherein at least one suction opening and one pressure opening are provided which are fixed to the casing and which communicate with said working cylinders, the improvement wherein said casing terminates in a tubular duct coaxial therewith that defines one of said openings and is of a diameter generally about the same as that of said drum to provide for the direct flow of said fluid medium to said working cylinders without undergoing a change in the direction of flow, said tubular duct terminating in a first connecting flange of a diameter generally about the same as that of said drum, and a second duct defines the other of said openings and terminates in a second connecting flange and extends to the side of said tubular duct, said cylinder drum is closed by a closure disc at a free end thereof against which a closure plate fastened to said casing is elastically pressed, and a leakage current valve is inserted into said free end of said cylinder drum.

17. In a machine of the axial piston pump type which can be selectively used as a pump or as motor for a fluid medium, which comprises a cylinder drum which is mounted rotatably in a casing and in which working pistons are axially displaceable in working cylinders in axial bores distributed over the periphery of the cylinder drum, wherein pistons rods are connected to the working pistons and have ends that run on a control cam which is fastened to the casing, said cam is concentric to a central shaft and extends undulatingly in the axial direction so that a rotary movement in the cylinder drum is converted into a reciprocating movement of the working pistons, or vice versa, and wherein at least one suction opening and one pressure opening are provided which are fixed to the casing and which communicate with said working cylinders, the improvement wherein said casing terminates in a tubular duct coaxial therewith that defines one of said openings and is of a diameter generally about the same as that of said drum to provide for the direct flow of said fluid medium to said working cylinders without undergoing a change in the direction of flow, said tubular duct terminating in a first connecting flange of a diameter generally about the same as that of said drum, and a second duct defines the other of said openings and terminates in a second connecting flange and extends to the side of said tubular duct, and characterized by two machines each as defined above, in which the cylinder drums of both machines are coupled together.

* * * * *